United States Patent [19]

Dowdall

[11] 4,263,887

[45] Apr. 28, 1981

[54] FORCED AIR WOOD FURNACE SYSTEM

[76] Inventor: Donald H. Dowdall, Rte. 1, Box 377, Bonner Springs, Kans. 66012

[21] Appl. No.: 43,758

[22] Filed: May 30, 1979

[51] Int. Cl.[3] ..... F24H 3/00; F24B 5/00

[52] U.S. Cl. ..... 126/116 A; 126/15 A; 126/99 R; 126/110 R; 126/111; 165/DIG. 2; 237/55; 431/18

[58] Field of Search ..... 126/15 R, 15 A, 111, 126/72, 77, 114, 116 A, 116 R, 110 R, 99 R, 67; 110/295, 296; 165/DIG. 2; 237/52, 53, 55; 431/18

[56] References Cited

U.S. PATENT DOCUMENTS

| | | | |
|---|---|---|---|
| 1,825,498 | 9/1931 | Wogan | 165/DIG. 2 |
| 2,578,927 | 12/1951 | Esson | 126/111 |
| 2,806,676 | 9/1957 | Frenkel | 165/DIG. 2 |
| 2,828,947 | 4/1958 | Hedbom | 165/DIG. 2 |
| 2,988,336 | 6/1961 | Woolard | 165/DIG. 2 |
| 3,169,516 | 2/1965 | Agnese | 126/111 |
| 4,078,541 | 3/1978 | Roycraft | 126/99 R |
| 4,130,105 | 12/1978 | Melton | 126/111 |
| 4,141,335 | 2/1979 | Wright | 126/111 |
| 4,147,303 | 4/1979 | Talucci | 126/110 R |
| 4,202,318 | 5/1980 | Depopesta | 126/111 |

*Primary Examiner*—James C. Yeung
*Assistant Examiner*—Daniel J. O'Connor
*Attorney, Agent, or Firm*—Lowe, Kokjer, Kircher Wharton & Bowman

[57] ABSTRACT

A refractory lined firebox is encased in a low profile furnace shell of generally rectangular configuration. Mounted on top of the firebox within the furnace shell is a heat exchanger which provides alternating passageways at right angles to one another through which flue gas and air to be heated flow in heat exchange relationship. The heat exchanger and firebox are so related that the axes of the passageways are inclined from the horizontal and the flow through them is generally upward as well as lateral. The furnace includes special combustion air ducts for use in combustion of the solid fuel. The furnace is also equipped with a back-up liquid fuel burner and a control system which activates and operates the liquid fuel burner in response to total consumption or burn out of the solid fuel in the firebox.

3 Claims, 10 Drawing Figures

FORCED AIR WOOD FURNACE SYSTEM

OBJECTS AND SUMMARY OF THE INVENTION

This invention relates generally to forced air furnace systems and relates more particularly to a furnace system in which the primary fuel is intended to be a solid fuel such as wood, but which is equipped also for back-up operation by a liquid fuel burner.

One of the principal objects of the invention is to provide a forced air furnace construction which lends itself particularly to the efficient combustion of a solid fuel such as wood and the effective transfer of heat resulting from such combustion to the air being circulated through the furnace. A principle feature of the invention in this respect lies in providing a firebox—heat exchanger design in which the overall height of the furnace is held to a very low value in comparison with other systems, and yet which promotes flow of air and flue gases through the heat exchanger with a minimum of friction and other losses resulting from tortuous flow paths. An additional feature of the invention is that the heat exchanger design is such that extremely effective heat transfer is accomplished.

Another object of the invention is to provide a wood burning furnace in which the air supplied for combustion is effectively introduced so as to insure of efficient combustion throughout the firebox.

Still another object of the invention is to provide a wood burning furnace system which also incorporates a liquid fuel combustion burner which is arranged to provide automatically a back-up source of heat to the firebox and heat exchanger in the event of complete consumption or burn out of the supply of solid fuel during operation. A special object of the invention in this respect is to provide a simple, safe and effective control system which ordinarily operates only on the basis of combustion of solid fuel but which, when the temperature drops low enough, sets the back-up liquid fuel burner in operation.

Another object of the invention is to provide a controlled system which makes it an easy manner to shift from liquid fuel combustion back to solid fuel combustion when the furnace has been reloaded with the solid fuel.

Further objects of the invention are to provide a wood burning forced air furnace which maintains closely controlled temperatures in the area to be served, which is clean and quiet in operation, which requires minimal tending during operation and which can be produced at a realistic cost.

Other and further objects of the invention, together with the features of novelty appurtenant thereto will appear in the course of the following description.

DETAILED DESCRIPTION

In the accompanying drawings, which form a part of the specification and are to be read in conjunction therewith, and in which like reference numerals indicate like parts in the various views.

Figure 2:
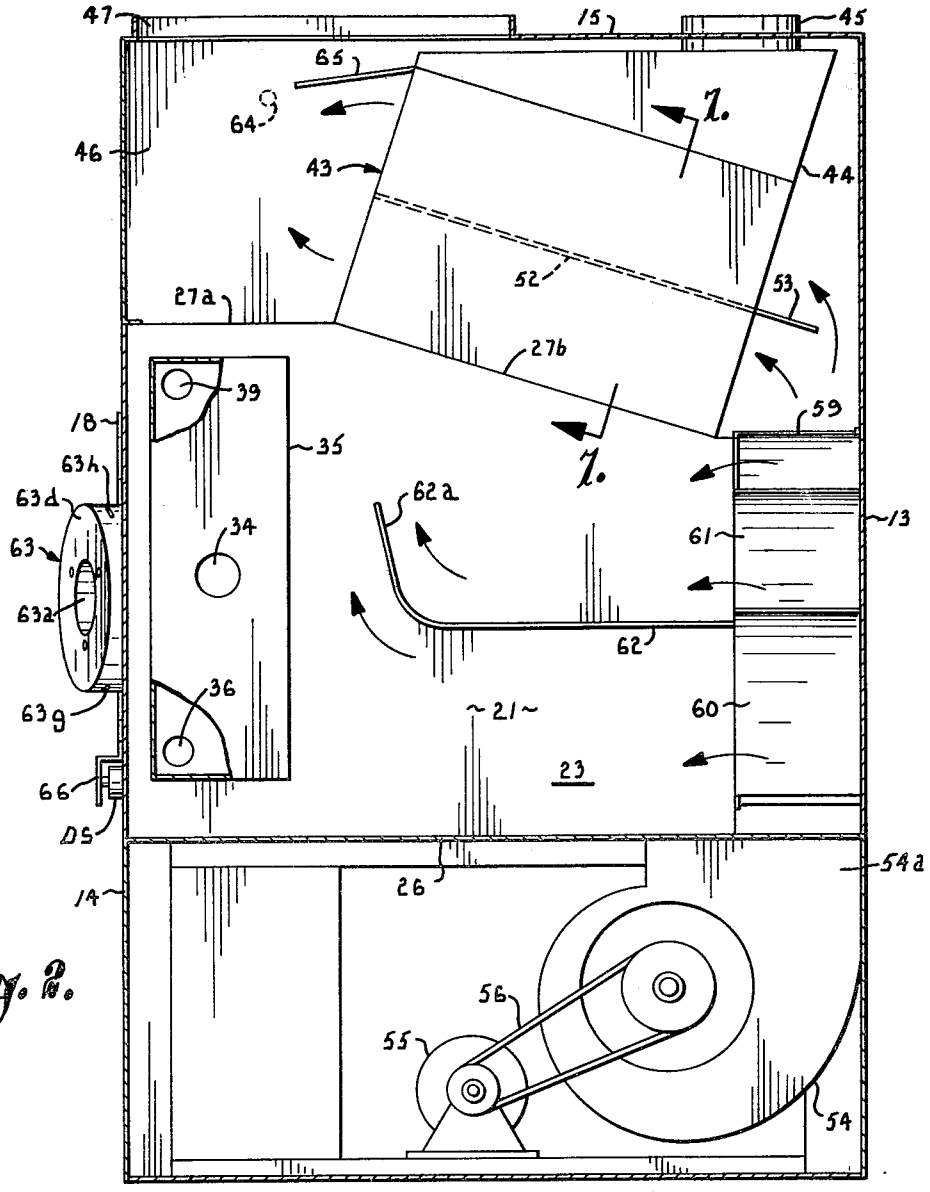
FIG. 2 is a side elevational view of same with the skin on the near side removed to expose the interior construction and with parts broken away for purposes of illustration.

The furnace outer shell consists of a generally rectilinear casing having the metal side walls 10, 11, bottom wall 12, rear wall 13, front wall 14 and top wall 15. The casing provides a hollow enclosure in which the various components of the furnace are contained.

Mounted on the front wall 14 is a door 16 which provides access to the firebox 17. The door 16 is insulated with refractory material as shown at 16*a*. The door is hinged for swinging movement about the hinges 18 and a conventional latch structure 19 is employed for securing the door in a closed position.

The firebox is formed as a separate shell having its own sides, back and bottom walls located within the furnace shell. It, too, is constructed of good quality metal sheeting. The firebox side walls 20 and 21 are spaced inwardly from the furnace side walls 10 and 11 so as to define air spaces 22, 23, respectively. The rear wall of the firebox 24 is spaced a substantially greater distance away from the rear wall 13 of the furnace to provide a combined duct and air space 25. The bottom wall of the firebox is indicated at 26 and is horizontal. The top wall consists of a short forward horizontal portion 27*a*. To the rear of portion 27*a*, the top of the firebox is open, and, as will be explained hereinafter, communicates with a special heat exchanger. It will be noted that the upper edges 27*b* of the firebox side walls are inclined downwardly and rearwardly back of the top wall 27*a*.

Figure 4:
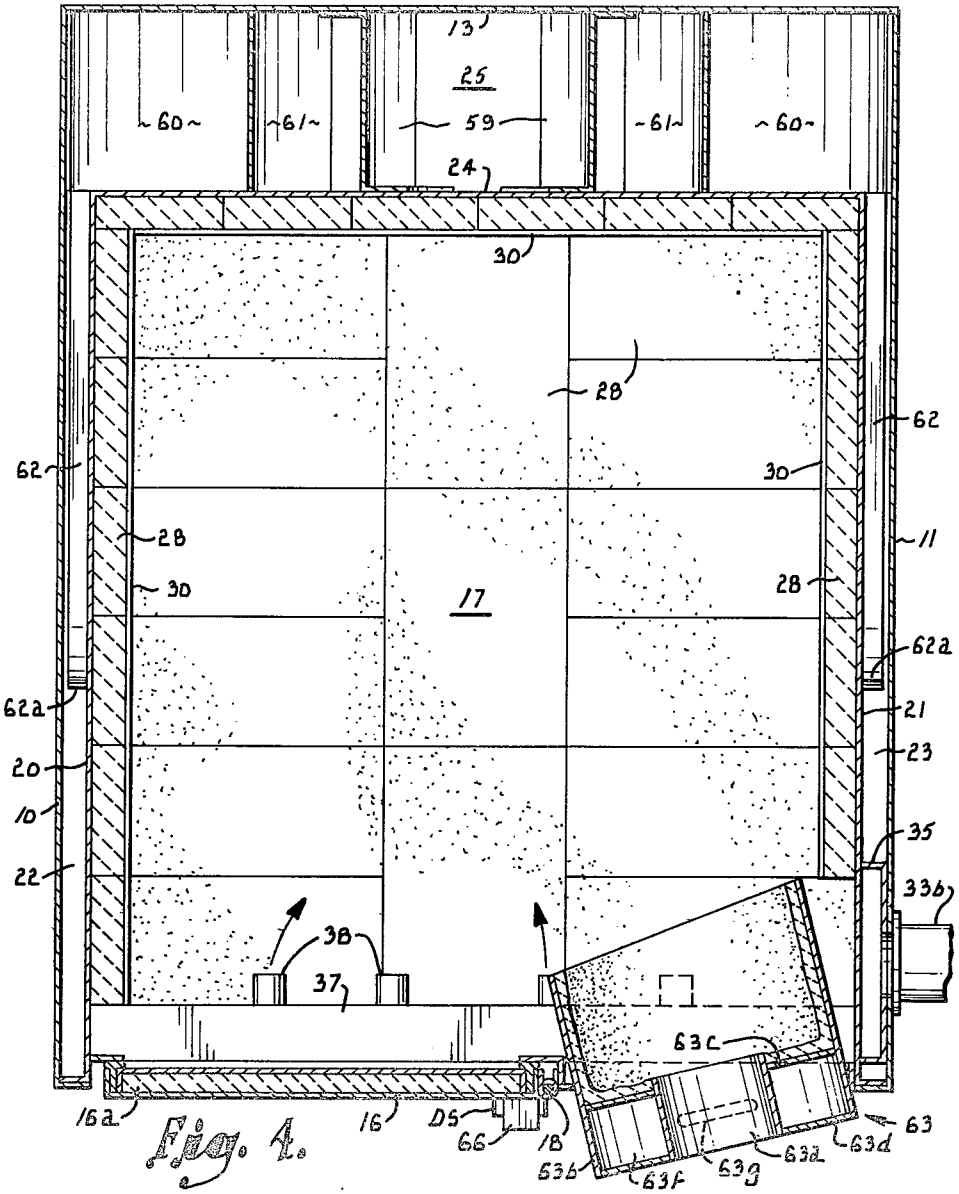
FIG. 4 is a sectional view taken generally on line 4—4 of FIG. 1 in the direction of the arrows.

The insides of the side back and bottom walls of the firebox are lined with fire brick installed in the form of rectangular units 28. The bricks are laid in a mosaic pattern on the bottom wall as shown in FIG. 4. On the side walls there are two rows of brick, as in the case on the back wall. With respect to the upper back wall and side walls, the upper rows of brick are held by Z sections 29, one flange of which is secured to the respective firebox wall, the other of which overlaps the upper margin of the bricks. The lower ends of the upper row of the upper row of bricks on the back and side walls are contained by the upper flange of a T section 30, the web of which secured to the respective wall. The lower flange of T section 30 engages the upper margin of the lower row of bricks on the back wall thereby to secure them in position.

Figure 5:
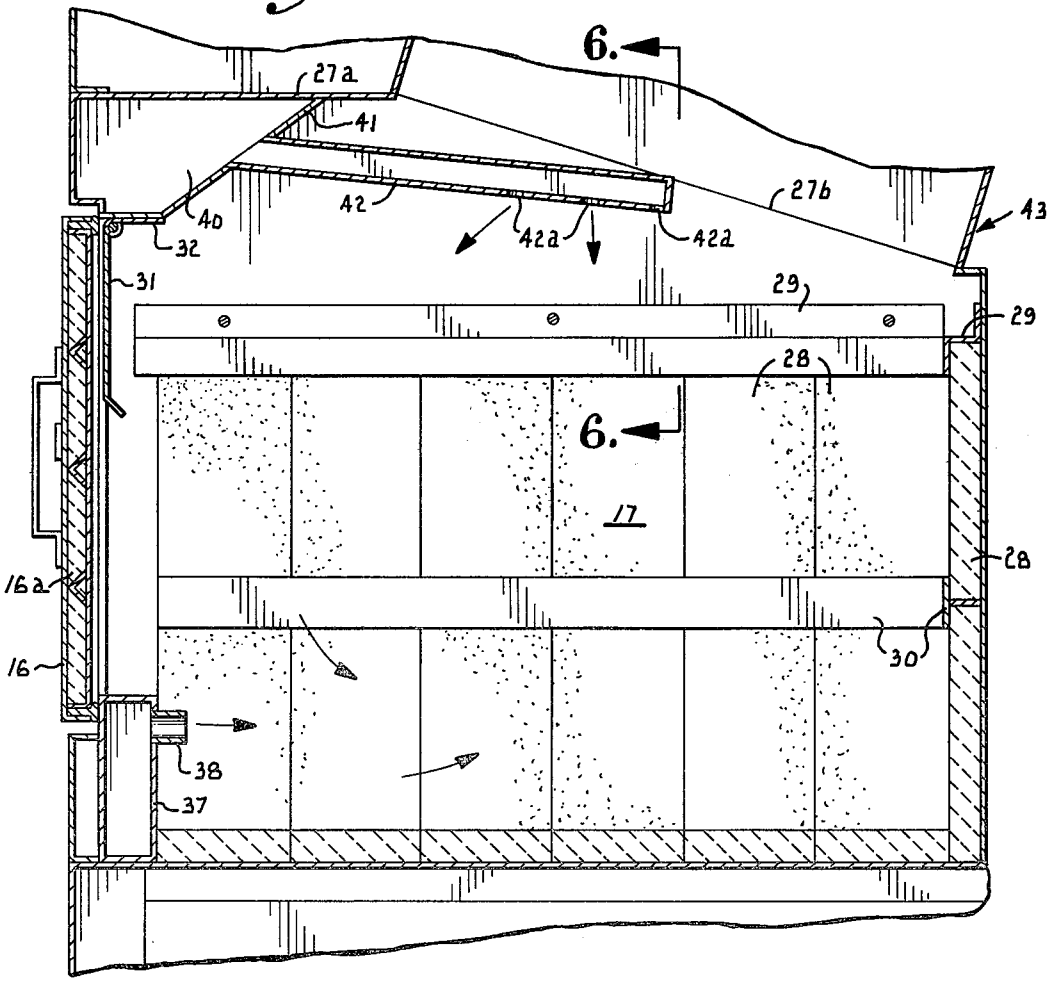
FIG. 5 is a fragmentary sectional view on an enlarged scale taken generally along line 5—5 of FIG. 1 in the direction of the arrows.

Also forming part of the firebox construction is a smoke damper 31. The damper is hingedly suspended from a hinge bracket 32 adjacent the door opening to the firebox, being located just inside the door as shown in FIG. 5. The smoke damper is mounted for swinging movement rearwardly into the firebox and permits easy insertion of the wood fuel or other combustible materials.

The primary and combustion air is supplied to the firebox by means of a combustion blower 33 which is mounted to the exterior of the side wall 11 and which is driven by an electric motor 33*a*. The discharge duct 33*b* of the combustion blower communicates through a port 34 with the interior of an air manifold 35 which is located in the space 23 between the outside wall 11 and the firebox side wall 21. The manifold 35 is rectangular in cross-section and has an outlet port 36 through the side wall 21 which connects with a primary combustion air duct 37 (see FIG. 5) which runs along the lower inside front wall of the firebox. This primary duct 37 (which is also seen in FIG. 4) is equipped with discharge nozzles 38 spaced at points along its length.

Located at the upper end of the primary air combustion manifold 35 is another port 39. This port is also through wall 21 and supplies air to an enclosed duct 40 (see FIG. 5) which runs across the upper front wall of the firebox. This duct is formed by an inclined partition 41 connecting the top and front walls above the door opening and extending between the two side walls of the firebox.

Air flowing into the secondary air duct 40 is directed by the duct to two laterally extending tubes 42 which extend toward the rear of the firebox. The tubes extend to approximately the fore and aft mid-point of the inclined open top of the firebox and have downwardly directed openings 42*a* from the secondary duct 40 and is discharged toward the burning solid fuel to provide a zone of secondary combustion located toward the upper part of the firebox.

Figure 7:
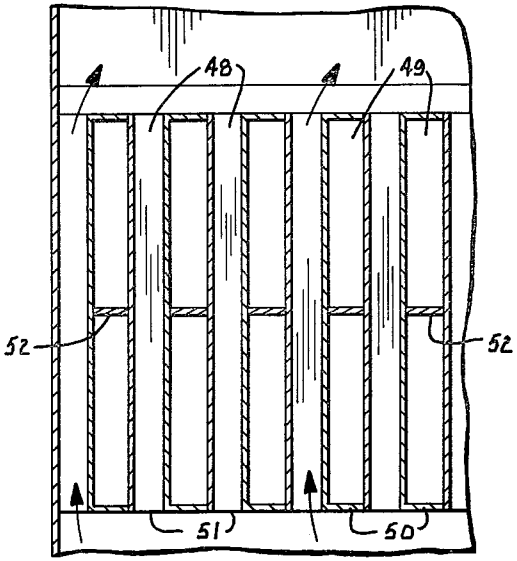
FIG. 7 is a fragmentary sectional view, on an enlarged scale, taken along line 7—7 of FIG. 2 in the direction of the arrows.

As previously noted, the open top wall portion of the firebox along lines 27*b* is formed by the bottom side of a heat exchange section 43. This heat exchanger is so constructed as to provide a plurality of parallel passageways arranged in two sets with the passageways of one set alternating with those of the other set transversely across the furnace. One set of passageways is in communication with the interior of the firebox and adapted to carry smoke and products of combustion upwardly and outwardly through the flue box 44 and to discharge through flue 45. The other set of passageways runs from right to left as viewed in FIG. 2, and provides for the passage of air to be heated to the discharge plenum 46 and the discharge duct 47. The flue gas passages through the heat exchanger are indicated at reference numeral 48 in FIG. 7 and the air heating passages are indicated at 49. As is evident, the channels or passageways are oriented with their longitudinal axes at right angles to each other. Preferably, the end most passageways are flue gas passageways, so there is one more of these than the air passageways.

The heat exchanger can easily be constructed of a series of channel shaped members stacked one upon another. The channels defining three of the sides of each of the circulated air passages are indicated at 50, and the interspersed channels which define three sides of each of the flue passageways, are indicated at 51. The width between side flanges of the channels 50 is equal to the length of the channels 51 and the width between the side flanges of the channels 51 is equal to the length of the channels 50.

The dimensions of the heat exchanger are important. The cross-sectional area of the flue gas passageways 48 should be about one and one-half times the cross-sectional area of the air passageways. As a specific example, for an air fan capacity of 1400–1600 CFM, the heat exchanger should be formed of 12 gauge hot rolled low carbon steel with the spacing between the passageway dividing walls being 1.375 inches. The long dimension of passages 48 is 20 inches and of the air passages 14 inches.

It will be noted that the passageways 49 are each subdivided approximately along the longitudinal center line by partitions 52. These partitions form a continuation of a flow divider 53 which is at the inlet to the air receiving portion of the heat exchanger and constitutes a rectangular plate extending across the face.

Air is circulated up around the outside of the firebox and through the heat exchanger 43 by means of a blower or fan 54 located in the space below the firebox. Fan 54 is powered by an electric motor 55, the driving connection being made by the V-belt 56. Air is drawn from the cold air duct system of the space served by the furnace through air return opening 57. It will be understood that the return opening can be located on the opposite side of the front or in other portions of the base of the furnace in order to supply return air to the fan. The space below the firebox and defined by the side, back and front walls of the furnace is partitioned from the spaces 22, 23 and 25 around the sides and back of the firebox by a horizontal deck plate 58 which underlies the firebox and extends from side to side and back to front of the inside of the furnace shell. The fan discharge duct 54*a* is connected with an opening through partition 58 to direct discharge of air into the central portion of the space 25 between the firebox and back wall.

Figure 3:
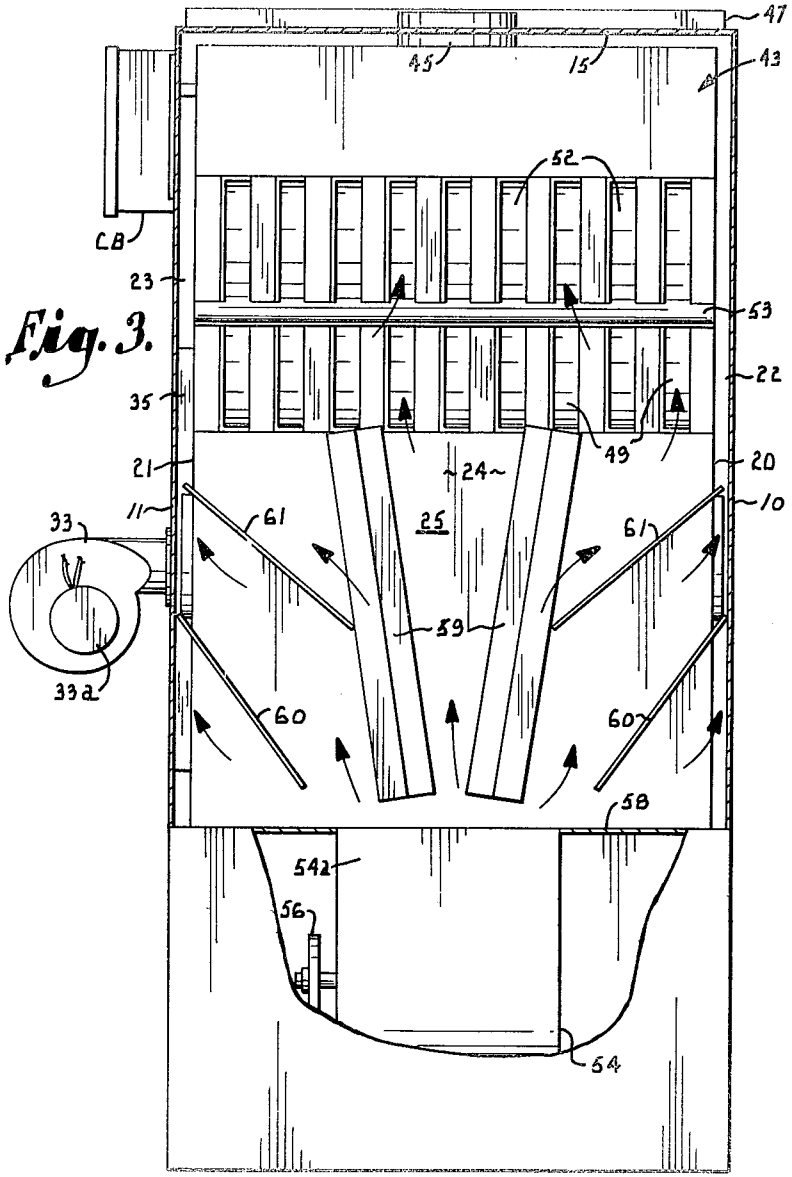
FIG. 3 is a rear elevational view of the furnace with the rear wall skin partially removed to expose inner components.
Figure 6:
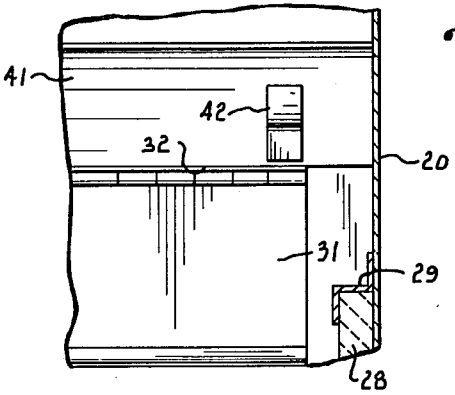
FIG. 6 is a fragmentary sectional view taken along line 6—6 of FIG. 5 in the direction of the arrows.

As can best be seen in FIGS. 2, 3 and 4, air flow directional control elements are located in spaces 25, 22 and 23, the purpose of which is to insure both of a distribution of flow such that substantially the entire back and side surfaces of the firebox will be contacted by air delivered by the fan and that the air to the inlet side of the heat exchanger 43 will be spread over substantially the full width thereof. One set of flow guides comprises the Z-shaped members 59 which are arranged symmetrically above the axis of the fan discharge duct and extend from the inside back wall of the furnace shell to the outside back wall of the firebox, to which they are secured. The second set of diverters in space 25 comprises the inclined plates 60 which likewise extend from front to back of space 25 and are arranged symmetrically to guide air into the lower portions of the side spaces 22 and 23. Located above converter plates 60 are similar diverter plates 61 which are inclined also and which serve to guide air into the upper portions of the spaces 22 and 23. It will be noted that the outermost ends of the plate 61 are spaced slightly from the inside surface of the walls 10 and 11. Thus to let air pass between the plates and those walls. The plates are supported by securing them to the back wall of the firebox.

Flow diverters are also located in the spaces 22 and 23. As can best be seen in FIG. 2, these comprise narrow shelf-like members 62 secured on their inside edge to the wall of firebox and extending toward the inside surface of the furnace shell walls. Each of the members 62 is provided with an upwardly curved portion 62*a*. The length of the horizontal portion of the member 62 is such that the upwardly turned portion 62*a* is located beyond the midway point of the side wall of the firebox. Air diverted toward the side walls by the inclined back plates 60 thus is guided forwardly and upwardly along the forward portions of the firebox side walls into the air discharge plenum 46. Air diverted into the side wall spaces by the upper inclined guide plates 61 is likewise turned upwardly so as to contact the rearward upper portion of the firebox side walls from whence it likewise flows into the air discharge plenum.

Returning now to a further description of the burner mount 63, and referring more particularly to FIGS. 2 and 4, the burner mount has a generally cylindrical outer wall **63*b* which is coaxial with the burner tube 63*a*. The mount is set in an opening in the front wall of the furnace and is oriented with its axis such that it fires generally toward the center of the back wall of the firebox. The inside of wall 63*b* is insulated forward of an annular partition 63*c*. Partition 63*c* forms with the annular back wall 63*d* of the mount an annular chamber 63*f* around the burner tube. An elongate opening 63*g* is cut through the outer wall 63*b* to communicate outside air with the interior of chamber 63*f*. One or more outlet opening 63*h* are located above the burner tube. Provision is thus made for induced convection flow of the air through bottom openings 63*g* into the lower part of the chamber and upwardly around the burner tube and out the upper openings 63*h*** thus to assist in insulating the exposed exterior portions of the burner mount from and carrying away the heat developed within the burner.

Figure 1:
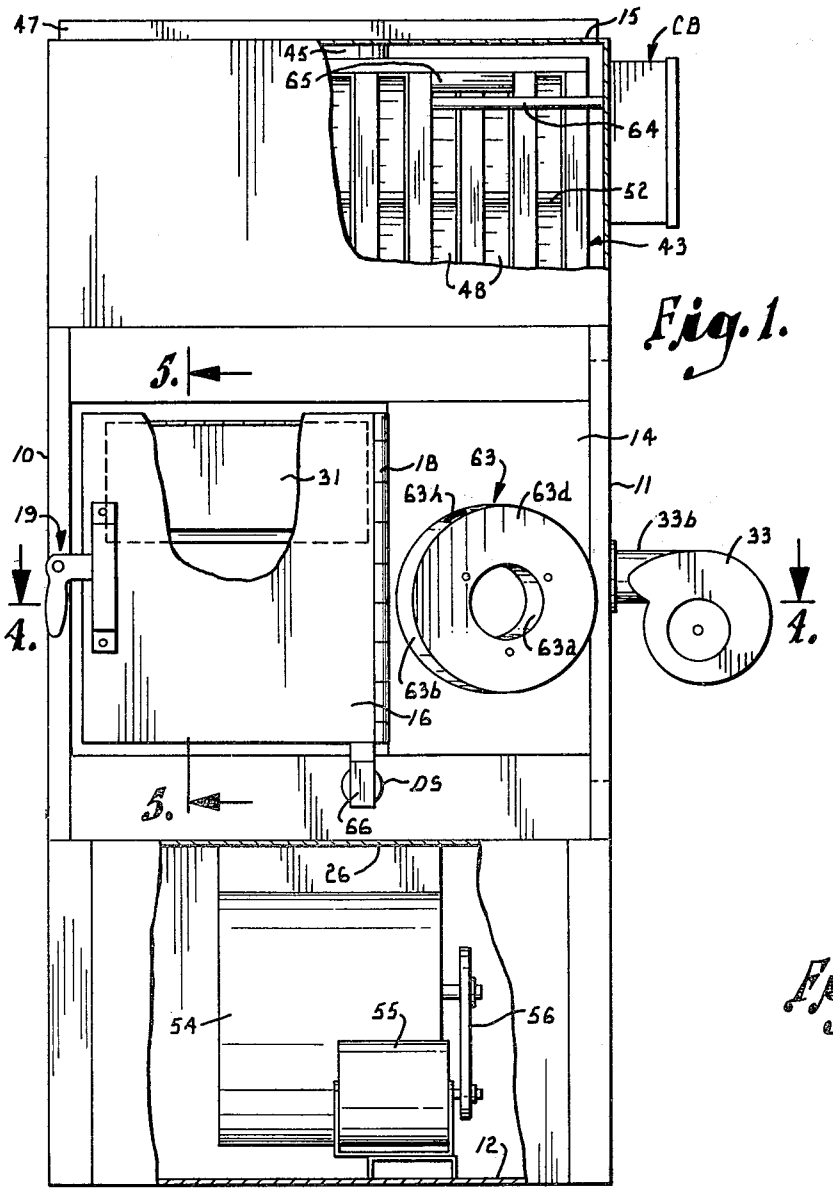
FIG. 1 is a front elevational view of a furnace according to the preferred embodiment of the invention, with parts broken away for purposes of illustration.
Figure 9:
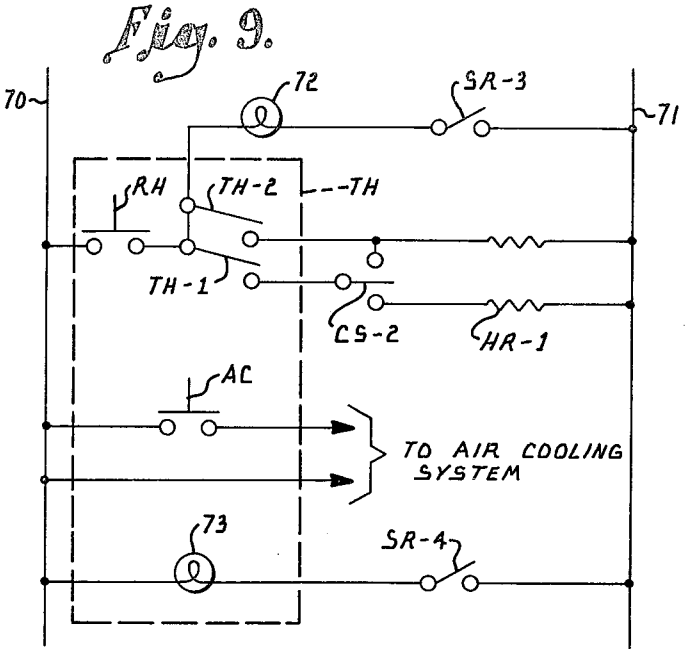
FIG. 9 is a schematic diagram of the low voltage control circuit.
Figure 10:
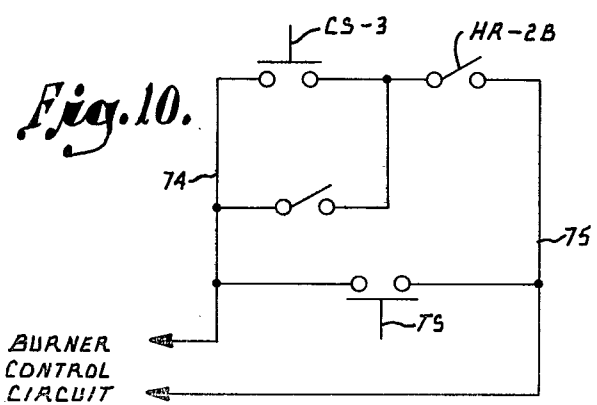
FIG. 10 is a schematic diagram of the circuitry of which goes to the oil or gas burner control circuit.
Figure 8:
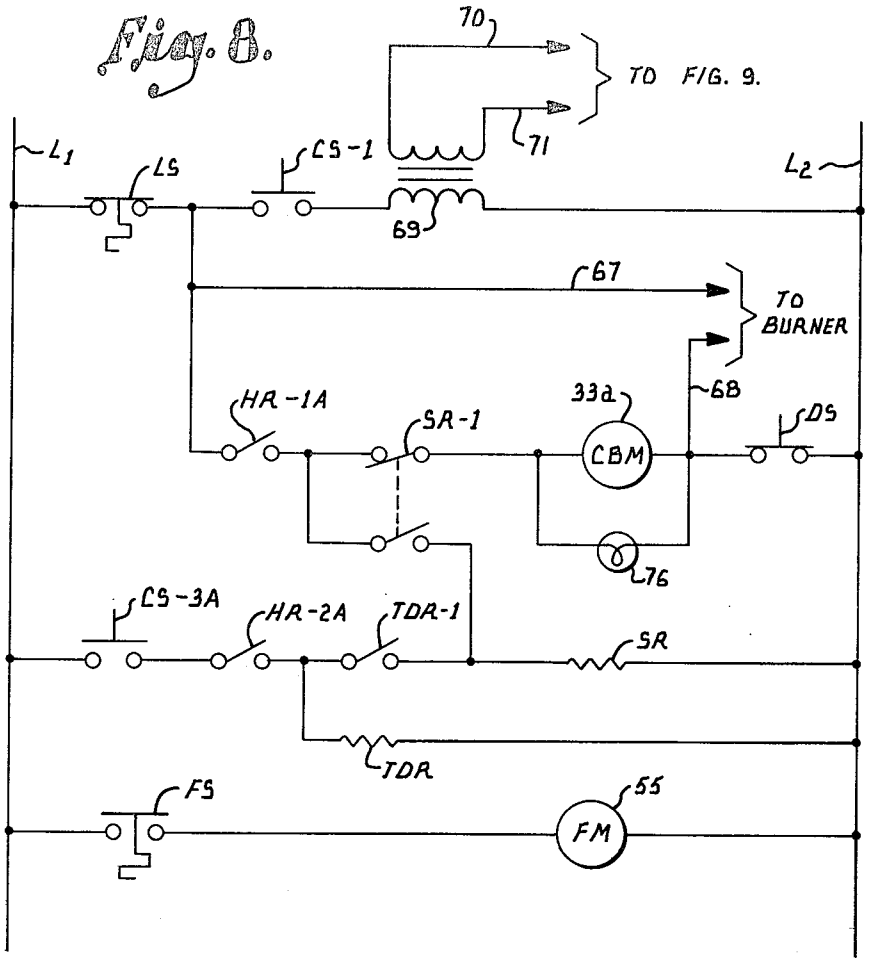
FIG. 8 is a schematic circuit diagram of the 110 volt AC circuit powering the air fan and combustion blower motors of the furnace.

The controls for the furnace as depicted in FIGS. 8, 9 and 10 and now to be described are housed within a control box CB which conveniently can be mounted on the outside of the furnace. Preferably the control box is so located that it is in a position close to the outlet from the heat exchanger. The reason for this is so that the temperature probe which operates certain temperature responsive switches in the control system can be positioned directly in the path of discharge flow from the heat exchanger. This probe is illustrated at 64 in FIGS. 1 and 2. It will be noted that a flow guide baffle 65 extends forwardly from the upper edge of the discharge side of the heat exchanger to assure of concentrated flow over the probe.

Both the combustion blower motor **33*a* and the main circulatory fan motor 55 are connected into a 110 volt alternating current circuit represented in FIG. 8. Power is supplied through lines L1, L2. The combustion blower motor 33*a* is located in a circuit which includes normally open relay contact HR-1A, normally closed relay contact SR-1, and a manual switch DS. The switch DS is a plunger type switch which is operated in response to opening and closing of the firebox door 16 and can be seen in FIGS. 1 and 2. It is mounted on the front wall of the furnace. The plunger is engaged by an arm 66 carried by the door. When the door is closed, the plunger of switch DS is depressed thereby maintaining the switch in a circuit closing condition. However, if at any time the door is opened, the plunger is released and the switch moves to the open position, thus breaking the circuit through the combustion blower motor and de-energizing it if it is then running. The door switch DS also controls a circuit including lines 67 and 68** which supply the 110 volt power to the burner (not shown).

FIG. 8 includes an additional circuit comprising a manual control switch CS-3A, the normally open relay contact HR-2, the time delay relay TDR and the switching relay coil SR which controls the normally closed relay contact SR-1 and the normally open contact SR-2. There is also a fan motor circuit a fan switch FS which is a heat sensitive switch and which is normally open at temperatures in the heat exchanger below a selected level.

A temperature sensitive limit switch LS controls the supply of power to the combustion blower motor circuit and the burner circuit. In addition, limit switch LS controls the supply of power to the transformer 69 which operates to supply power, through at a reduced voltage (say 24 volts), through lines 70 and 71 to the control circuit illustrated in FIG. 9.

The "cut-off," or opening temperature is set so that the system will be de-energized if the temperature at probe 64 exceeds a selected level, say 165° F.

The broken line box TH in FIG. 9 represents the thermostat panel which will be located at a selected location in the area being serviced by the furnace. The thermostat includes the main "heat" switch RH which is manually closed when the system is to call for heat. It will remain so closed until manually reopened.

The switch RH is in a circuit which includes the thermostatically responsive switches TH-1 and TH-2. Switch TH-1 is designed to close in accordance with the desired temperature level at which the area is to be maintained. TH-2 is designed to close at a temperature which is somewhat lower than that which will activate TH-1. I have found that for the purposes of the present invention a differential of 12° F. works satisfactorily. Switch TH-1 controls a circuit which can be set by selector switch CS-2 to include either the relay coil HR-1 or relay coil HR-2. The thermoswitch TH-2 controls a circuit through relay coil HR-2. An additional circuit controlled by the manual switch RH includes an indicator lamp 72 and the normally open relay contact SR-3.

The control panel can also have a separate circuit involving the switch AC to the air cooling system which does not form any part of the present invention. In addition, there is a circuit including lamp 73 which is operated under the control of the normally open relay contact SR-4.

The control box also includes a burner control circuit as illustrated in FIG. 10. This circuit runs to the conventional burner operating controls. It includes the manual selector switch CS-3 which is connected into a circuit including normally open relay contact HR-2A. A second path through HR-2A is controlled by the normally open relay contact SR-4. The burner control circuit also includes a manually operable test switch TS which can close the circuit between lines 74 and 75 to test burner operation.

To utilize the furnace for heating with wood fuel, a fire is built in the firebox and permitted to reach a stage which can best be described as an idle stage. This simply means that the fire is burning well but on its own with no combustion air being supplied. The switches at the control panel are manipulated so as to close the "heat" switch RH and the selector switch CS-2 is moved to close the path to the relay coil HR-1.

In addition, the control switch CS-1 is closed (this switch and the wiring can be also located at the control box for convenience) thus to supply power through the transformer 69 to the control circuitry of FIG. 9.

As the temperature declines in the area to be served, the thermostat switch TH-1 closes and energizes the relay coil HR-1. This in turn closes the normally open contact HR-1A, thereby completing a circuit through and energizing the combustion blower motor **33*b*. The combustion blower will supply the primary and secondary air to the firebox through nozzles 38 and ports 42a of tubes 42 as earlier described. This will cause the fire to burn more intensely, resulting in a rise in temperature in the heat exchanger. The temperature sensitive fan switch FS closes after the temperature at the heat exchanger rises to the desired degree (in this case 140 degrees F.) at which time the fan motor 55 is energized. The fan will of course cause air to be circulated up around the exterior of the firebox in the manner earlier described and also to flow in heat transfer relationship with the flue gases through the passages of the heat exchanger 43. The flow divider 53** and the divider partitions within the air flow passages cause the air to distribute itself fairly uniformly through the vertical dimensions of the heat exchanger and prevents the concentration of the air flow in only the upper portion of the heat exchanger.

As the fan continues to circulate the heated air, the temperature in the room area will rise until the first stage thermostat is satisfied thus opening the switch TH-1. This in turn de-energizes relay HR-1, thereby permitting relay contact HR-1A of FIG. 8 to open. The combustion blower motor will thereupon stop, thus permitting the plenum temperature to cool down. When the temperature decreases to the limit set in the fan switch FS, the fan likewise will shut off. The fire returns to the idle condition.

So long as the wood fire is providing sufficient heat to heat the area being served, only the thermostatic switch TH-1 will come into play, and the operation will be confined to the starting and stopping of the combustion blower motor and the air circulation fan motor. If, however, the wood fuel is completely consumed and the temperature thus drops to the level selected for closing of the thermostatic switch TH-2 (e.g., 12° F. below the setting for closing of TH-1), the following sequence of events takes place.

Upon the closing of the thermostatic switch TH-2, the relay coil HR-2 is energized. Relay HR-2 has two contacts. HR-2A of the FIG. 8 circuit is closed, completing a circuit through the time delay relay TDR and the coil of the switch relay SR. This relay is of the type which provides a delay from time of energization to time of closing of the relay contact. I prefer a delay of a few minutes for example, 4 minutes, before relay contact closes. Upon closing of the TDR relay contact, the switching relay coil SR is energized. As a result several operations occur.

Still referring to FIG. 8, relay contact SR-1 will open and the combustion blower motor will be de-energized. At the same time relay contact SR-2 closes, establishing a path through the switching relay which is independent of the circuit controlled by HR-2A. This in effect latches the switching relay in the "on" condition and at the same time latches the combustion blower motor "out." However, by virtue of line 67 and 68 power is still available to the burner.

Referring to FIG. 10, with the control switch CS-3 open it will be noted that the burner control circuit is energized through the closing of contact of HR-2B (which occurs on closing of thermostatic switch TH-2) and upon energization of the switching relay SR, which closes contact SR-4. The burner is now "on."

After the burner fires, the temperature in the area being served should rise to satisfy the temperature set for closing of TH-2 and TH-2 will open, thereby dropping out relay HR-2 and opening contacts HR-2A and HR-2B. This shuts off the burner and the temperature will remain at this "set-back" temperature of 12 degrees less than the actual setting for TH-1. It will be noted however that the switching relay SR remains energized and the system is ready to initiate immediate starting of the burner should TH-2 again call for heat.

To resume wood fuel operation, the operator will of course open the firebox door 16 in order to permit the feeding of the wood fuel to the firebox. Opening of the door opens the door switch DS, thus cutting off any possible operation of combustion blower motor or the burner while the door is open. Once the fuel is loaded and the door closed, the door switch will reclose and the second stage, or "set back," operation will resume. Ignition of the burner will result in a flame directed toward the wood fuel and the wood fuel will ignite. The operator should allow sufficient time for the wood to become fully ignited (usually 15 minutes). At this time the operator then releases the switching relay SR from its latching condition by moving the switch RH of FIG. 9 to the "off" position, and then immediately back to the closed or "heat" position.

When switch RH is moved to "off" (TH-1 is still presumably closed because of the low temperature) the relay HR-1 is dropped out. This causes relay contact HR-1A of FIG. 8 to open, breaking the circuit through the switching relay SR and dropping it out. This causes relay contact SR-1 to reclose. When RH is returned to the "on" or "heat" position, relay HR-1 is again energized, thus closing contact HR-1A and resuming the circuit through the combustion blower motor area. Providing wood fuel has been properly ignited, the combustion air supplied by the combustion blower motor will cause a temperature rise and the system operates as earlier described.

As a matter of convenience, for operation in milder weather the operator may choose to operate the unit as though it were a regular oil or gas furnace. This is accomplished by moving control switch CS-2 to the upper position, thus connecting TH-1 with relay HR-2. Control switch CS-3 of of FIG. 10 is also closed. CS-3 is also associated with CS-3A of FIG. 8 in a way such that closing of CS-3 opens CS-3A, thereby breaking the circuit through contact HR-2A through the switching relay SR. Thereafter, the operation of thermostatic switch TH-1 will result in stopping and starting of the burner through opening and closing of relay contact HR-2B. The fan will operate intermittently as earlier described.

The indicator lamp 72 is illuminated at times when the system is in the secondary or back-up stage since the switching relay SR is energized and relay contact SR-3 is closed completing a circuit through the heat on switch RH and the lamp. The second indicator lamp 73 is also energized at any time the switching relay is engaged whatever the condition at switch RH may be. In addition, there is a combustion blower motor indicator lamp 76 (FIG. 8) in which provides an indication of energization of the combustion blower motor.

From the foregoing it will be evident that the dual fuel furnace arrangement provided by the invention is one that combines efficiency with convenience without sacrificing safety. The control system allows the secondary or "back-up" system to function only after the primary fuel has been completely consumed. The air flow and heat exchange patterns produced by the heat exchanger and flow guides insures of extremely good exchange from the firebox and flue gas passages to the circulated air. The primary and secondary air combustion produces extremely efficient burning of the wood fuel.

From the foregoing it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawing is to be interpreted as illustrative and not in a limiting sense.

Having thus described the invention, I claim:

1. A dual fuel furnace system comprising a solid fuel firebox means for combustion of solid fuels, a back-up liquid fuel burner means mounted for directing flame and products of combustion into said firebox, a heat exchanger means arranged to have a first set of passageways for receiving flue gases from said firebox and a second set of passageways blocked from said firebox but in heat exchange relationship with said passageways of said first set, fan means for forcing air through said second set of passageways and circulating it through an area to be heated, temperature sensing means in said area including first and second thermostatic switch means, said first switch means operable to control combustion of said solid fuel in response to a temperature demand at a preselected level, said second switch means operable to initiate and control combustion of said liquid fuel in the event the temperature in said area to be heated drops below a preselected temperature which is lower than the demand temperature at which said first switch is operated.

2. A system as in claim 1, said system including means for inactivating said first switch and maintaining said system under control of said second switch.

3. A system as in claim 1, said system including a solid fuel combustion air blower operable in response to said first switch to supply combustion air to said firebox, and means controlled by said second switch for inactivating said combustion air blower at times when said system is under the control of said second switch.

* * * * *